US007850366B2

(12) United States Patent
Kisakibaru

(10) Patent No.: US 7,850,366 B2
(45) Date of Patent: Dec. 14, 2010

(54) SHEET FOR SHIELDING SOFT X-RAYS IN A REMOVER USING SOFT X-RAYS THAT REMOVES STATIC CHARGES AND A METHOD OF MANUFACTURING IT

(75) Inventor: Toshirou Kisakibaru, Tokyo (JP)

(73) Assignees: Kondoh Industries, Ltd., Tokyo (JP); Cambridge Filter Japan, Ltd., Tokyo (JP)

( * ) Notice: Subject to any disclaimer, the term of this patent is extended or adjusted under 35 U.S.C. 154(b) by 142 days.

(21) Appl. No.: 12/438,263

(22) PCT Filed: Aug. 22, 2007

(86) PCT No.: PCT/JP2007/066260

§ 371 (c)(1),
(2), (4) Date: Feb. 20, 2009

(87) PCT Pub. No.: WO2008/023727

PCT Pub. Date: Feb. 28, 2008

(65) Prior Publication Data

US 2010/0176315 A1 Jul. 15, 2010

(30) Foreign Application Priority Data

Aug. 23, 2006 (JP) ..... 2006-226515

(51) Int. Cl.
*H01J 35/16* (2006.01)

(52) U.S. Cl. ..... 378/203; 250/515.1

(58) Field of Classification Search ..... 378/203; 250/505.1, 515.1

See application file for complete search history.

(56) References Cited

FOREIGN PATENT DOCUMENTS

| | | |
|---|---|---|
| JP | 2001257096 | 9/2001 |
| JP | 2005019044 | 1/2005 |
| JP | 2005339921 | 12/2005 |

*Primary Examiner*—Courtney Thomas
(74) *Attorney, Agent, or Firm*—Sunstein Kann Murphy & Timbers LLP

(57) ABSTRACT

A sheet 1 for shielding soft X-rays comprises a first outer sheet, an interlayer sheet, and a second outer sheet. In the first outer sheet a port for supplying ionized air is formed. In the interlayer sheet a passage for the ionized air, which passage communicates with the port for supplying the ionized air, is formed. In the second outer sheet a port for discharging the ionized air, which port communicates with the passage for the ionized air, is formed. The sheets 2, 3, and 4 are stacked and adhered so that the sheet 1 has one or more portions 9 for transmitting the ionized air, which portions connect the port for supplying the ionized air, the passage for the ionized air, and the port for discharging the ionized air.

6 Claims, 7 Drawing Sheets

SHEET FOR SHIELDING SOFT X-RAYS IN A REMOVER USING SOFT X-RAYS THAT REMOVES STATIC CHARGES AND A METHOD OF MANUFACTURING IT

TECHNICAL FIELD

The present invention relates to a sheet for shielding soft X-rays that is used for a remover using soft X-rays that removes the static charges. In manufacturing substrates of semiconductors, liquid crystals, or organic electroluminescence (EL), the remover prevents some dust from adhering to their surfaces. It also prevents the substrates from being charged by static electricity. Thus, it prevents the breaking of the circuits of the substrates. The present invention also relates to a method of manufacturing it.

BACKGROUND ART

Many problems occur, such as static charges on the surfaces of the substrates of semiconductors, liquid crystals, and organic EL, causing their circuits to break. The charges are built up on the surfaces when manufacturing or handling them. In addition, the charges of the substrates cause some dust to adhere on the surfaces.

To solve these problems, an ionizer is provided for each manufacturing device for semiconductors, liquid crystals, or organic EL, so as to prevent or remove the static charges on the surfaces of the substrates. There are two types of ionizer. One is an electric ionizer, in which the air is ionized by applying a high voltage to it. The other is an ionizer using soft X-rays, in which the air is ionized by irradiating it with soft X-rays.

As a prior patent publication on a remover using soft X-rays that removes the static charges, Japanese Patent Publication No. 2001-257096 (prior patent publication 1) is known.

The electric ionizer is easy to handle, but has some problems such as the wear of the electrode caused by discharging it at a high voltage for a long time. Thus, the electrode must be replaced. It also has problems such as dust being generated and adhering to a substrate.

The electric ionizer has further problems such as harmful effects being caused on the substrates by oxidizing or deteriorating them because it generates a great amount of ozone.

On the contrary, the ionizer using soft X-rays does not generate ozone. Thus it is a clean ionizer. However, it has a problem in that it must have a structure that prevents soft X-rays from leaking outside, because soft X-rays have harmful effects on a human body.

Ionizers using soft X-rays in which only ionized air is taken out, and without leaking soft X-rays, have been developed. However, all of them have problems such as the portion for blowing out ionized air being complicated and large, and the passage for the ionized air being difficult to be curved or shortened. Thus, it has been difficult to efficiently take out a great amount of ionized air.

Prior patent publication 1 discloses the following embodiment. A tube for soft X-rays is installed in a fan-filter-unit to generate ions inside the unit. Two plates with punched holes are disposed at the side for blowing out the ionized air. They are stacked with a clearance of 3 mm so that the openings of one plate do not overlap those of the other. A honeycomb sheet is further stacked on them. By doing so, only the ionized air is blown out, and no soft X-rays leak. Then the time for removing static charges from a charged article is measured.

However, the ionizer of prior patent publication 1 has problems such as an insufficient performance to block soft X-rays and a long time being necessary for removing static charges from a charged article. Thus it does not comply with the requirements from the manufacturers for shielding soft X-rays and shortening the time for removing the static charges from a charged article in the present removers.

The recent requirements from the manufacturers of liquid crystals and semiconductors have become more severe. They strongly request that the functions to shield soft X-rays be enhanced so that their leakage is further reduced or becomes almost zero, to safeguard operators.

To comply with such requirements from the manufacturers in regards to the functions, the need has arisen to fundamentally rethink the ways to block soft X-rays and take out ions. The present invention was made in view of such requirements. It provides a sheet for shielding soft X-rays to prevent them from leaking from the port for discharging the ionized air. The soft X-rays that enter the sheet from the port for supplying the ionized air hit at least three times before reaching the port for discharging the ionized air. Thus, their travel in a straight line is prevented. So they can be attenuated or made to disappear.

SUMMARY OF THE INVENTION

The present invention solves the problems by employing the following means. The means comprises a first outer sheet, an interlayer sheet, and a second outer sheet. All are made of materials that are opaque to soft X-rays. In the first outer sheet a port for supplying the ionized air is formed. In the interlayer sheet a passage for the ionized air, which communicates with the port for supplying the ionized air, is formed. In the second outer sheet a port for discharging the ionized air, which communicates with the passage for the ionized air, is formed. The first outer sheet, the interlayer sheet, and the second outer sheet are stacked and adhered to form one or more portions for transmitting the ionized air that connect the port for supplying the ionized air, the passage for the ionized air, and the port for discharging the ionized air.

The soft X-rays that enter the sheet from the port for supplying the ionized air hit at least three times before reaching the port for discharging the ionized air. Thus, their travel in a straight line is prevented, to have them thereby be attenuated or have them disappear. Therefore, their leakage from the port for discharging the ionized air is prevented. The passage for the ionized air that is required to have the soft X-rays be attenuated or have them disappear is shortened. Thus the reduction of plus ions or minus ions caused by their recombination or the absorption of them into the inner surface is prevented, to thereby increase the number of ions that are taken out through each portion for transmitting the ionized air. Further, the pattern of the portion for transmitting the ionized air can be compacted or the number of the portions for transmitting the ionized air that are formed in a sheet is increased. Thus the number of ions per sheet for shielding soft X-rays increases. These are beneficial effects.

DESCRIPTION OF A PREFERRED EMBODIMENT

Below, the embodiments of the present invention will be described with reference to the drawings.

Embodiment 1

Now embodiment 1 of the present invention is described with reference to the drawings. The sheet for shielding soft X-rays of embodiment 1 comprises three sheets. They are made of materials that are opaque to soft X-rays. Openings for ionized air that have different patterns are formed in each sheet. The three sheets are stacked and adhered together. Thus, in the sheet for shielding soft X-rays one or more portions for transmitting the ionized air are formed.

FIGS. 1 and 2 illustrate an exploded perspective view and a cross sectional view of the sheet for shielding soft X-rays of embodiment 1 of the present invention, respectively. The sheet of embodiment 1 comprises three sheets, that is, a first outer sheet 2, an interlayer sheet 3, and a second outer sheet 4. In the first outer sheet 2 ports 5 for supplying the ionized air are formed. In the interlayer sheet 3 a passage 7 for the ionized air, which passage has ports 6 for introducing the ionized air at both ends, is formed. In the second outer sheet 4 a port 8 for discharging the ionized air is formed.

Two ports 5 for supplying the ionized air are formed at the respective ends of the first outer sheet 2 to maintain the space between them. The passage 7 for the ionized air in the interlayer sheet 3 has the ports 6 for introducing the ionized air at the positions for communicating with the ports 5 for supplying the ionized air. The passage 7 communicates with each of the ports 6. The port 8 for discharging the ionized air in the second outer sheet 4 is formed at the position to communicate with the passage 7 for the ionized air in the interlayer sheet 3.

By stacking the first outer sheet 2, the interlayer sheet 3, and the second outer sheet 4, and adhering them together, the ports 5 for supplying the ionized air in the first outer sheet 2 communicate with the ports 6 for introducing the ionized air in the interlayer sheet 3, respectively. The passage 7 for the ionized air in the interlayer sheet 3 communicates with the port 8 for discharging the ionized air in the second outer sheet 4 at the center of the passage 7 to form one or more portions 9 for transmitting the ionized air. Thus, the sheet 1 for shielding soft X-rays is produced. FIG. 1 illustrates one portion 9 for transmitting the ionized air being formed.

The passage 7 for the ionized air is configured to have bends 11 where the passage 7 curves at 90 degrees on the plane of the interlayer sheet 3. Thus, the number of hits against the inner walls 4*a* and 2*a* of the second outer sheet 4 and the first outer sheet 2 increases. This results in the soft X-rays 10 being attenuated and causing them to disappear while traveling from the port 5 for supplying the ionized air to the port 8 for discharging the ionized air.

Each bend 11 of the passage 7 for the ionized air has a smooth curve so as to reduce the fluid resistance of the ionized air 12. Thus, the ionized air 12 quickly reaches the port 8 for being discharged, so that the recombination of plus ions 13 and minus ions 14 is suppressed. The passage 7 for the ionized air has at least one bend 11 where it bends at 90 degrees on the plane so as to have the soft X-rays 10 disappear by causing the air to hit the inner walls.

The operation of the sheet for shielding soft X-rays of embodiment 1 of the present invention, which sheet is used for a remover using soft X-rays that removes the static charges, is now described with reference to FIG. 2. Upstream of the sheet 1, ionized air 12, which is ionized into plus ions 13 and minus ions 14 by soft X-rays 10, is pressurized. The ionized air 12 flows through ports 5 for supplying the ionized air into the sheet 1. It flows through the ports 6 and passage 7. Then, it flows to the downstream portion of the sheet 1 through the port 8 for discharging the ionized air.

The soft X-rays 10 enter the sheet 1 through the ports 5 in a straight line. As shown in FIG. 2, at least three times they hit the inner wall 4*a* of the second outer sheet 4 and the inner wall 2*a* of the first outer sheet 2 before reaching the port 8 for discharging the ionized air via the ports 6 and the passage 7. Because their path is configured to prevent them from traveling in a straight line, they are attenuated and disappear by being caused to hit the inner walls 4*a*, 2*a*. Thus, the leakage of harmful soft X-rays from the port 8 for discharging the ionized air is prevented.

The ionized air 12, which is introduced from the ports 5 for supplying it, reaches the port 8 for discharging the ionized air via the passage 7. The pattern of the passage 7 can be shrunk by means of the bends 11, which are provided to prevent soft X-rays from leaking. Further, the fluid resistance is reduced by making the bends 11 curve smoothly so that the ionized air quickly reaches the port 8 for discharging it. Thus, the recombination of the plus ions 13 and minus ions 14 is suppressed. Therefore, a great number of ions are discharged from the port 8 for discharging the ionized air.

The sheet 1 for shielding soft X-rays as in FIGS. 1 and 2 has two ports 5 for supplying, and one port 8 for discharging, the ionized air. The two flows of the ionized air 12 from the ports 5 collide at the port 8. Thus, the ionized air 12 from the port 8 for discharging it blows out vertically.

Embodiment 2

Now embodiment 2 of the present invention is described with reference to the drawings. Embodiment 2 differs from embodiment 1 only in that it has two layers that correspond to the interlayer sheet in embodiment 1. The passage 7 for the ionized air in embodiment 1 is divided and formed in two sheets, a first and a second interlayer sheet 22, 23.

The first and second interlayer sheets 22, 23, which constitute the sheet for shielding soft X-rays, which sheet is used for a remover using soft X-rays that removes the static charges, is configured as seen in FIGS. 3 and 4. In the first interlayer sheet 22, ports 26 for introducing the ionized air are formed at the positions to communicate with the ports 25 for supplying the ionized air in the first outer sheet. It has the same configuration as that of embodiment 1. Each port 26 opens on respective first passages 28*a* for the ionized air. These passages are short and have bends 27 that curve at 90 degrees on the plane of the sheet. The bends 27 have smooth curves 29. These curves have the same configurations as do the curves in embodiment 1.

The second interlayer sheet 23 has a second passage 28*b* for the ionized air. The passage is short and straight and communicates with the short first passages 28*a* when the first interlayer sheet 22 is stacked on the second interlayer sheet 23. The second outer sheet 30 has a port 31 for discharging the ionized air. This port 31 has the same configuration as that in embodiment 1.

By stacking the first interlayer sheet 22 on the second interlayer sheet 23, the first passage 28*a* communicates with the second passage 28*b* to form a passage 28 for the ionized air. The passage has steps.

When the first outer sheet 24, the first interlayer sheet 22, the second interlayer sheet 23, and the second outer sheet 30 are stacked and adhered like in embodiment 1, the ports 25 for supplying the ionized air in the first outer sheet 24 communicate with the passage 28. It is formed in the first and second layers 22, 23. The passage 28 communicates with the port 31 for discharging the ionized air in the second outer sheet 30 at the center of the passage 28 to form one or more portions 33 for transmitting the ionized air. Thus, the sheet 21 for shielding soft X-rays of embodiment 2 of the present invention is produced. FIG. 4 illustrates one portion 33 for transmitting the ionized air being formed.

The operation of embodiment 2 of the present invention is now described. In the sheet 21 for the shielding soft X-rays of embodiment 2, which sheet is used for a remover using soft X-rays that removes the static charges, unlike the sheet 1 of embodiment 1 the passage 28 for the ionized air is formed in two sheets, the first and second interlayer sheets 22, 23. Thus, because the passage 28 has steps, soft X-rays 10, which enter from the ports 25, repeatedly hit the inner wall 23*a* of the second interlayer sheet 23, the inner wall 24*a* of the first outer sheet 24, and the inner wall 30*a* of the second outer sheet 30.

By forming the steps in embodiment 2, the number of hits against the inner walls 23*a*, 24*a*, 30*a* increases more than do the number in embodiment 1. The length of the passage 28 in a plane is shortened. As a result, the pattern of the ports in the sheet 21 for shielding the soft X-rays of embodiment 2 can be shrunk.

The other operations and effects are the same as those of embodiment 1. Thus, the descriptions are omitted. Because the pattern of the ports in the sheet 21 is shrunk, the degree of integration of the passage 28 in the sheet 28 increases to enable the amount of the ionized air that is discharged to increase.

Though two interlayer sheets are used in FIGS. 3 and 4, the passage for the ionized air, which has a plurality of steps, may be formed in two or more sheets.

FIG. 5 illustrates the sheet 1 for shielding soft X-rays that is manufactured by stacking and adhering three sheets as embodiment 1. In the sheet 1 in FIG. 5 the ports 5 for supplying the ionized air in the first outer sheet 2, the passage 7 for the ionized air in the interlayer sheet 3, and the ports 8 for discharging the ionized air in the second outer sheet 4, are formed by photographic technology and etching, or pressing. 340 portions 9 for transmitting the ionized air are formed. The sheet 1 for shielding soft X-rays is manufactured by stacking and adhering these three sheets 2, 3, and 4.

The specification of the sheet 1 in FIG. 5 is as follows.

1. The size of the sheet: 150 mm×150 mm
2. The thicknesses of the sheets
   The first outer sheet: 300 μm
   The interlayer sheet: 300 μm
   The second outer sheet: 200 μm
3. The pattern of the ports: as shown in FIG. 1
   The size of the pattern of the portion for transmitting the ionized air: 5 mm×4 mm
4. The number of the patterns of the ports: 340 per sheet After attaching the sheet 1 for shielding soft X-rays to a remover using soft X-rays that removes the static charges, the functions of shielding soft X-rays and removing the static charges are tested. The experimental arrangement is shown in FIG. 6.

The Test of the Functions of Shielding Soft X-rays of the Sheet

In FIG. 6 the sheet for shielding soft X-rays of the present invention is attached to the remover. A tube for generating soft X-rays is activated. A device for measuring soft X-rays (STATIRON, manufactured by Shishido Electrostatic, Ltd.) is moved closer to the sheet to measure the leakage of the soft X-rays. The device continues to indicate zero. Thus the leakage of soft X-rays is supposed to be less than 0.5 μSv/h, which is the level of X-rays that exists in nature. As the result of the measurement of the sheet, at the Tokyo Metropolitan Industrial Technology Research Institute, the leakage of soft X-rays is found to be less than 0.00005 μSv/h.

The Performance Test of Removing the Static Charges by the Remover Equipped with the Sheet for Shielding Soft X-rays After attaching the sheet for shielding soft X-rays of the present invention to the remover in FIG. 6, air is fed to the remover. The tube for generating soft X-rays is activated. The performance of removing the static charges is measured. As the parameters, the velocity of the ionized air at a device for measuring the performance of removing the static charges is switched between three levels, to measure the performance. The results that are measured are shown in FIG. 7. Though the results of plus ions are shown in FIG. 7, similar results are observed in minus ions. The performance is indicated by the time taken for removing the static charges from +1 kV to +100 V or from −1 kV to −100 V after charging the upper plate of the device.

The specifications of the sheet for shielding soft X-rays that is used for the performance test are as follows.

1. The thickness of the first outer sheet that has the ports for supplying the ionized air: 300 μm
2. The thickness of the interlayer sheet that has the passages for the ionized air: 300 μm
3. The thickness of the second outer sheet that has the ports for discharging the ionized air: 200 μm
4. The length of the path from the ports for supplying the ionized air to the port for discharging the ionized air via the passages for the ionized air: 3 mm
5. The width of the passages for the ionized air: 0.3 mm In addition, the performance test is carried out by using a sheet for shielding soft X-rays that has the following specifications.

1. The thickness of the first outer sheet that has the ports for supplying the ionized air: 500 μm
2. The thickness of the interlayer sheet that has the passages for the ionized air: 500 μm
3. The thickness of the second outer sheet that has the ports for discharging the ionized air: 400 μm
4. The length of the path from the ports for supplying the ionized air to the port for discharging the ionized air via the passages for the ionized air: 3 mm
5. The width of the passages for the ionized air: 0.6 mm The performance of shielding the static charges is the same as that of the former sheet. The performance of removing the static charges improves twice as much as that of the former sheet.

The pattern of the portion for transmitting the ionized air is designed so that the cross-sectional area of the passage for the ionized air is enlarged, to reduce the loss of pressure. By doing so, a thin sheet for shielding X-rays by which ionized air is efficiently taken out, even when using a low-pressure fan, can be made.

An experiment is performed to determine the specification of the portion for transmitting the ionized air that is the most efficient in taking out ions. In the experiment the pressure of the air source is considered. The experiment is performed by changing the sizes of the parts of the portion under the condition of perfectly shielding all X-rays. As a result, the best specification is as follows.

1. The thickness of the first outer sheet that has the ports for supplying the ionized air: 200-600 μm
2. The thickness of the interlayer sheet that has the passages for the ionized air: 200-600 μm
3. The thickness of the second outer sheet that has the ports for discharging the ionized air: arbitrary
4. The length of the path from the ports for supplying the ionized air to the port for discharging the ionized air via the passages for the ionized air: 2-6 mm
5. The width of the passages for the ionized air: 0.2-1.2 mm
6. The number of hits against the inner walls in the path from the ports for supplying the ionized air to the port for discharging the ionized air via the passages for the ionized air (for descriptive purposes the path or reflection of soft X-rays is considered as that of a light, though it differs from that of a light due to secondary and tertiary radiation): 3 or more Though the present invention is described by using some embodiments, they are only for an explanation and do not limit the scope of the invention. One having ordinary skill in the art may conceive of variations, changes, and modifications on the basis of the embodiments. The present application is intended to include such variations, changes, and modifications.

Figure 1:
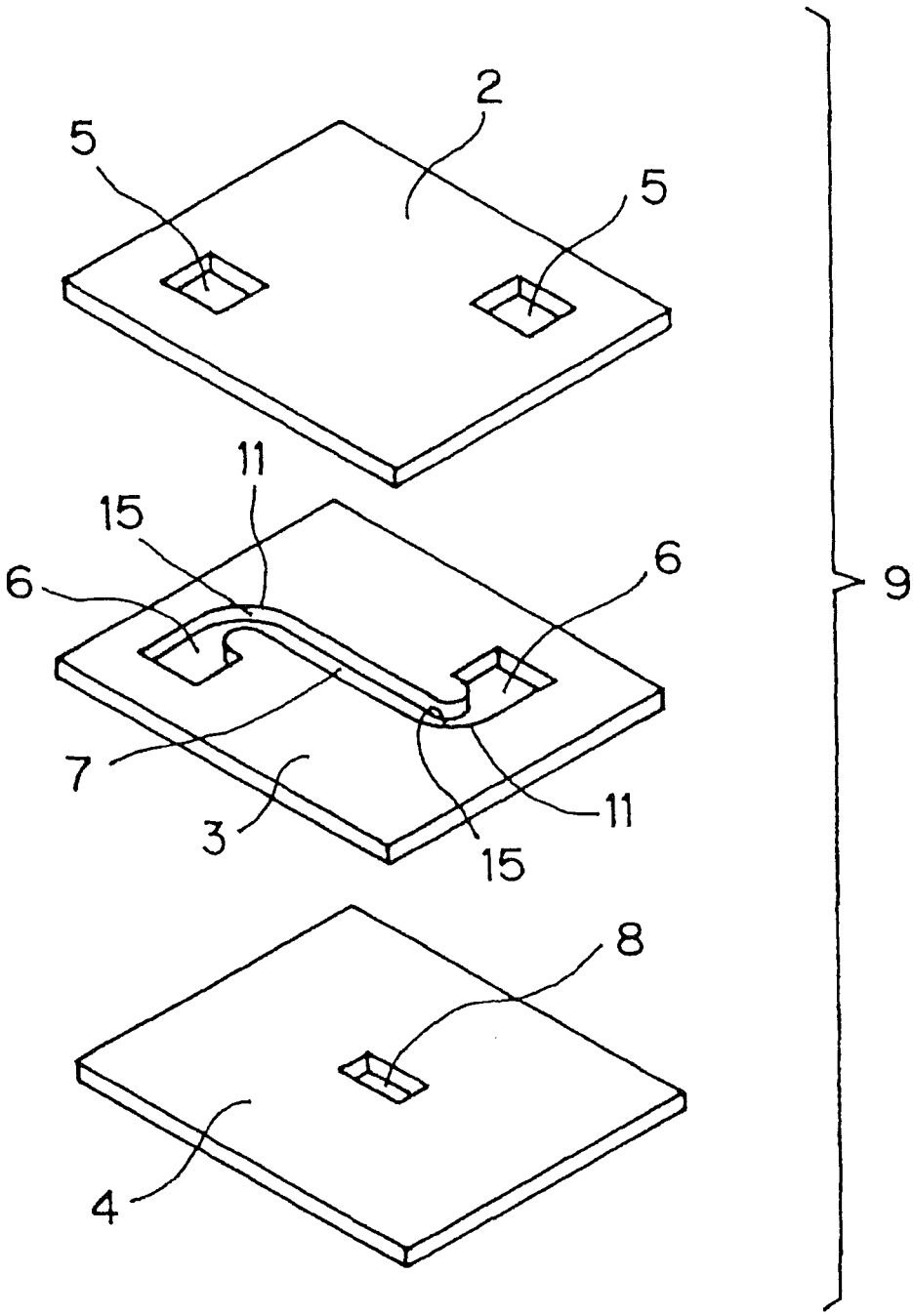
FIG. 1 is an exploded perspective view of the sheet for shielding the soft X-rays of embodiment 1 of the present invention.
Figure 2:
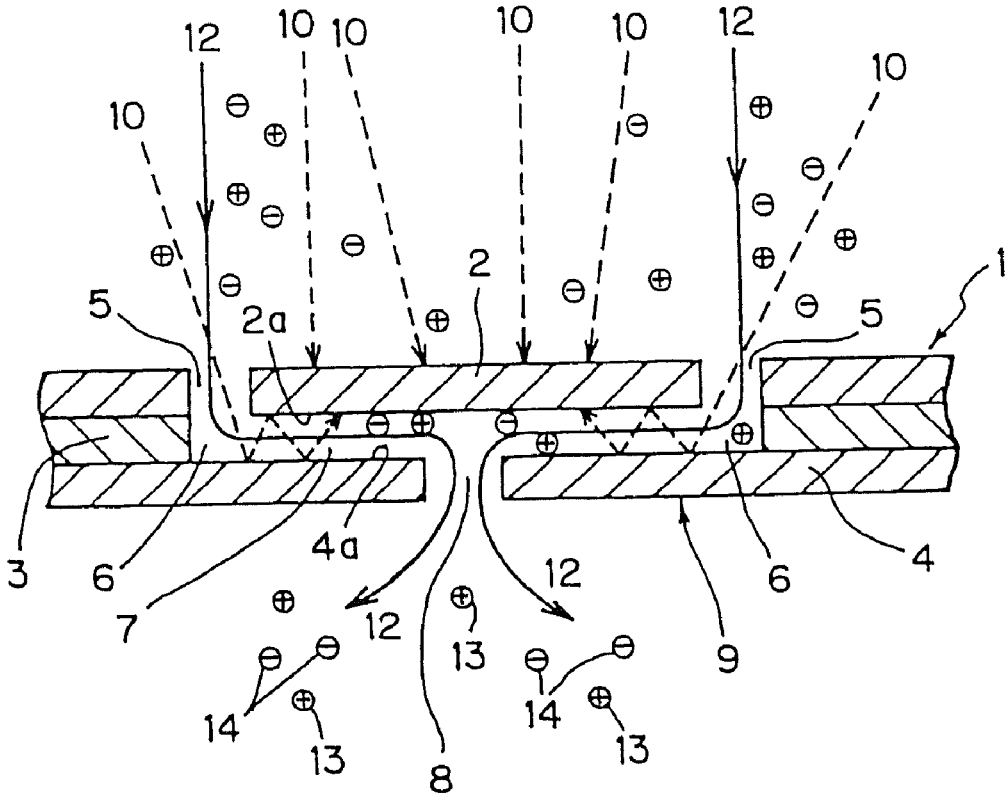
FIG. 2 is a cross sectional view of the sheet for shielding the soft X-rays of embodiment 1 of the present invention.
Figure 3:
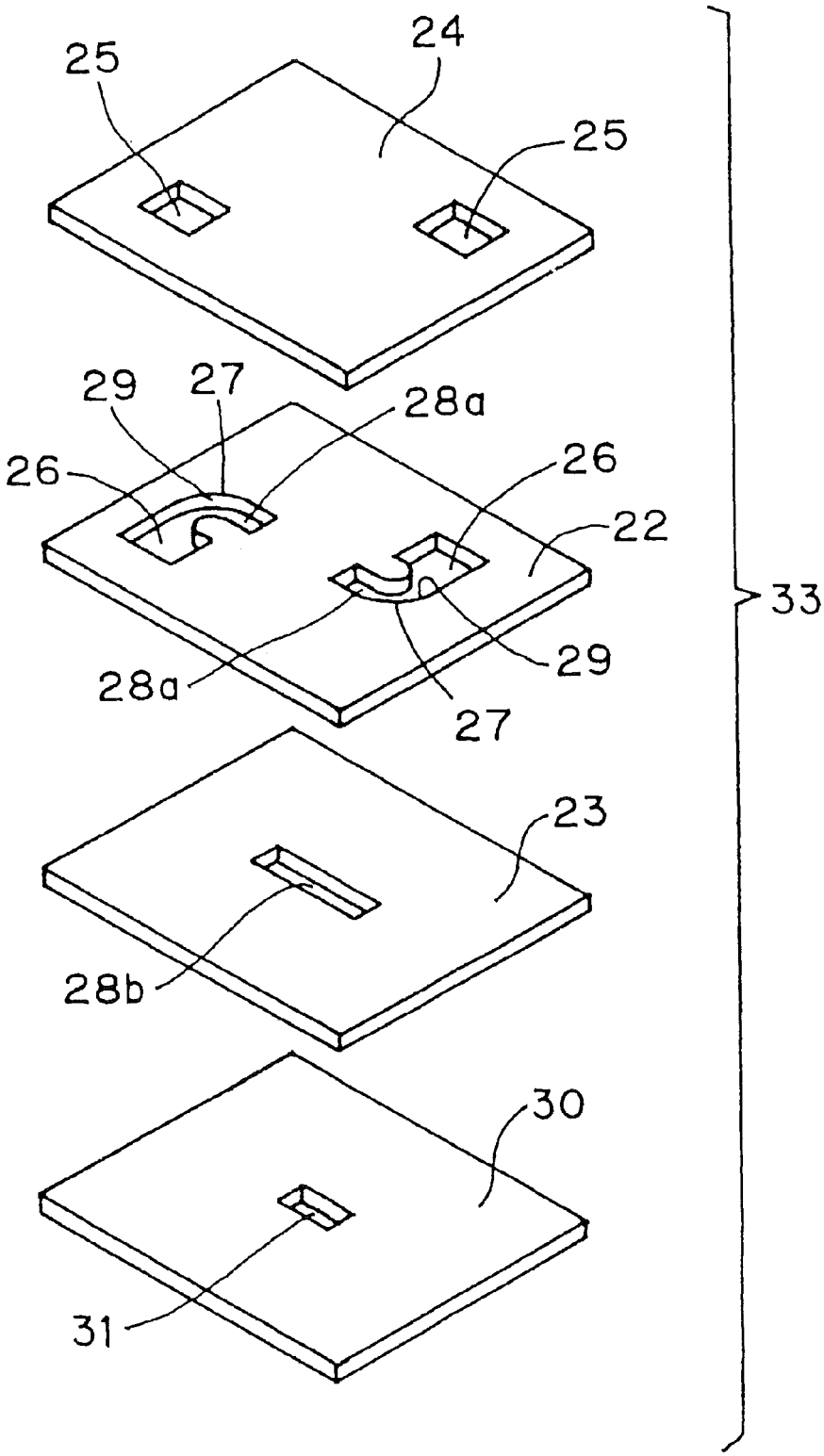
FIG. 3 is an exploded perspective view of the sheet for shielding the soft X-rays of embodiment 2 of the present invention.
Figure 4:
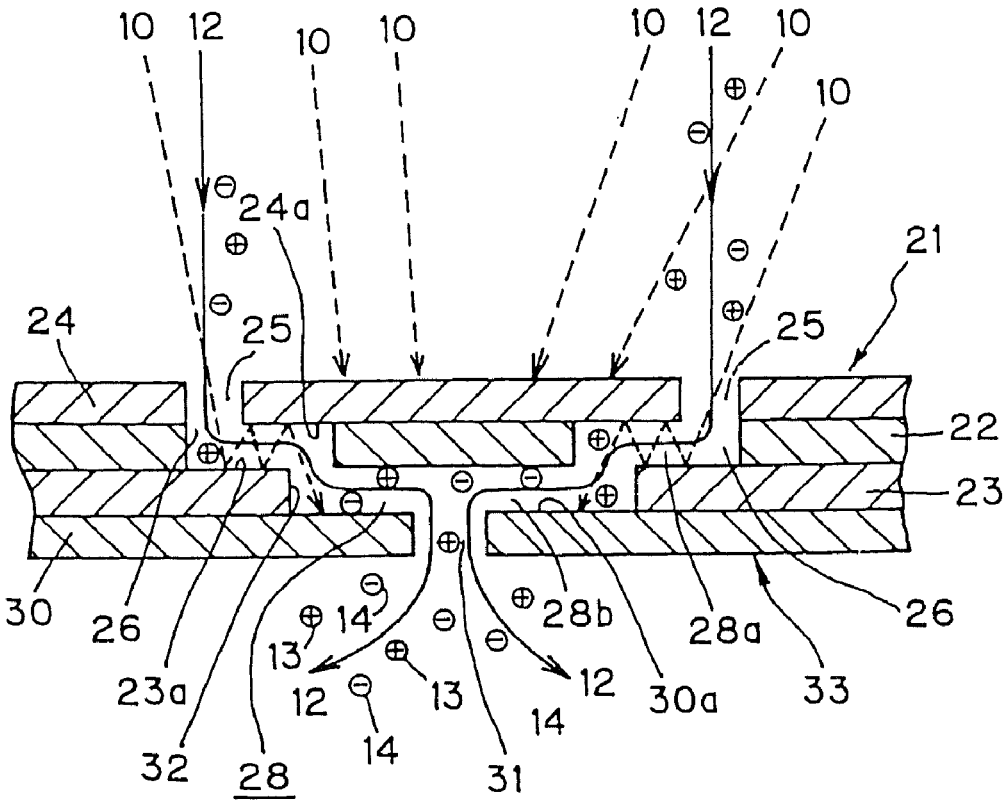
FIG. 4 is a cross sectional view of the sheet for shielding the soft X-rays of embodiment 2 of the present invention.
Figure 5:
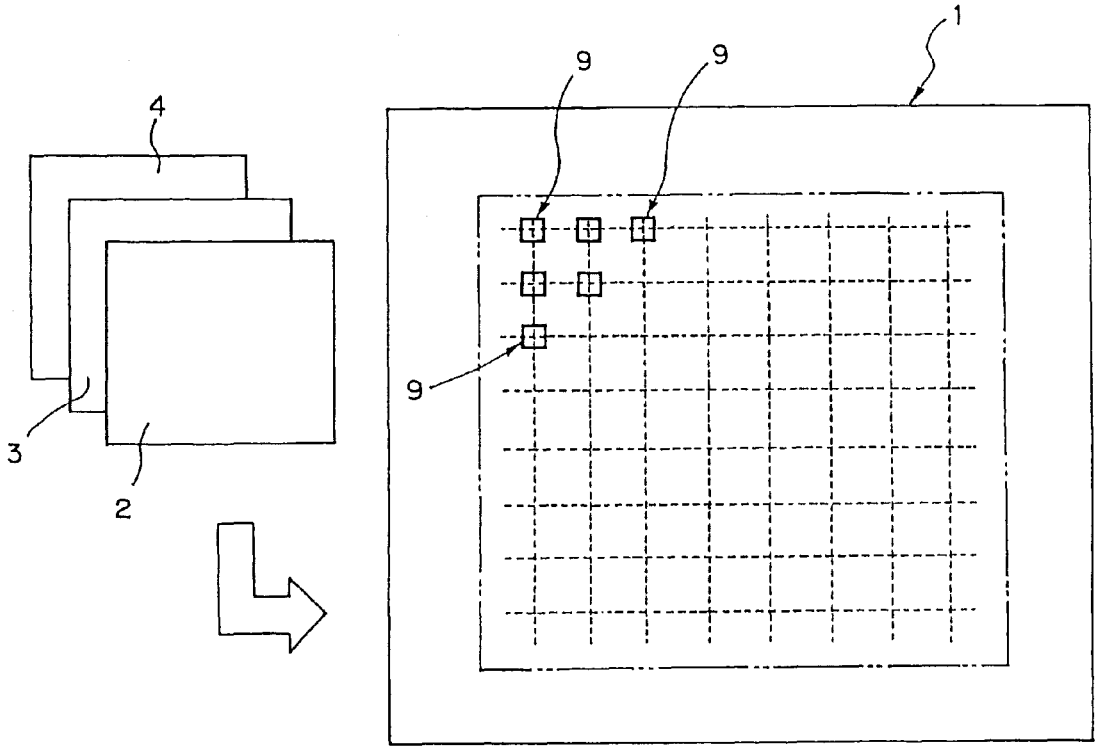
FIG. 5 illustrates the sheet for shielding soft X-rays that is manufactured by the method of manufacturing a sheet for shielding soft X-ray that is used for a remover using soft X-rays that removes the static charges.
Figure 6:
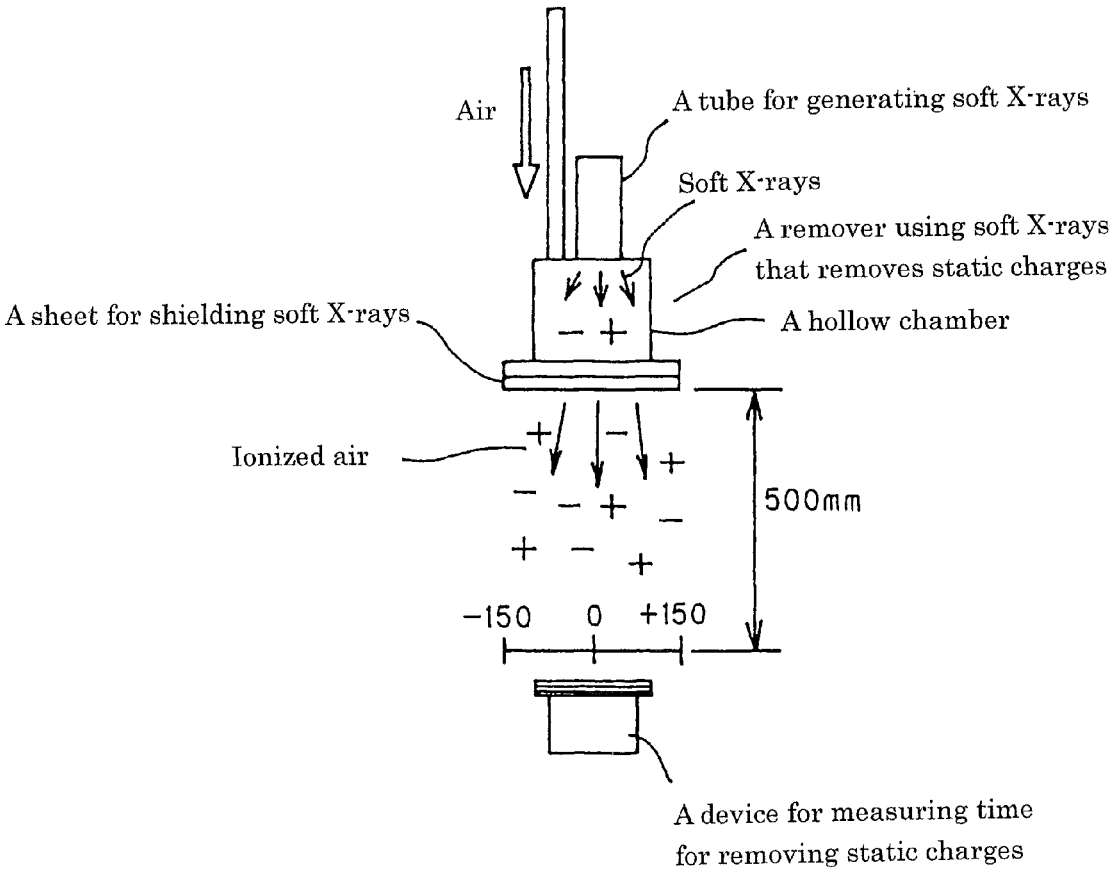
FIG. 6 illustrates an experimental arrangement for measuring the leakage of soft X-rays. The sheet for shielding soft X-ray of the present invention is attached to the remover using soft X-rays that removes the static charges.
Figure 7:
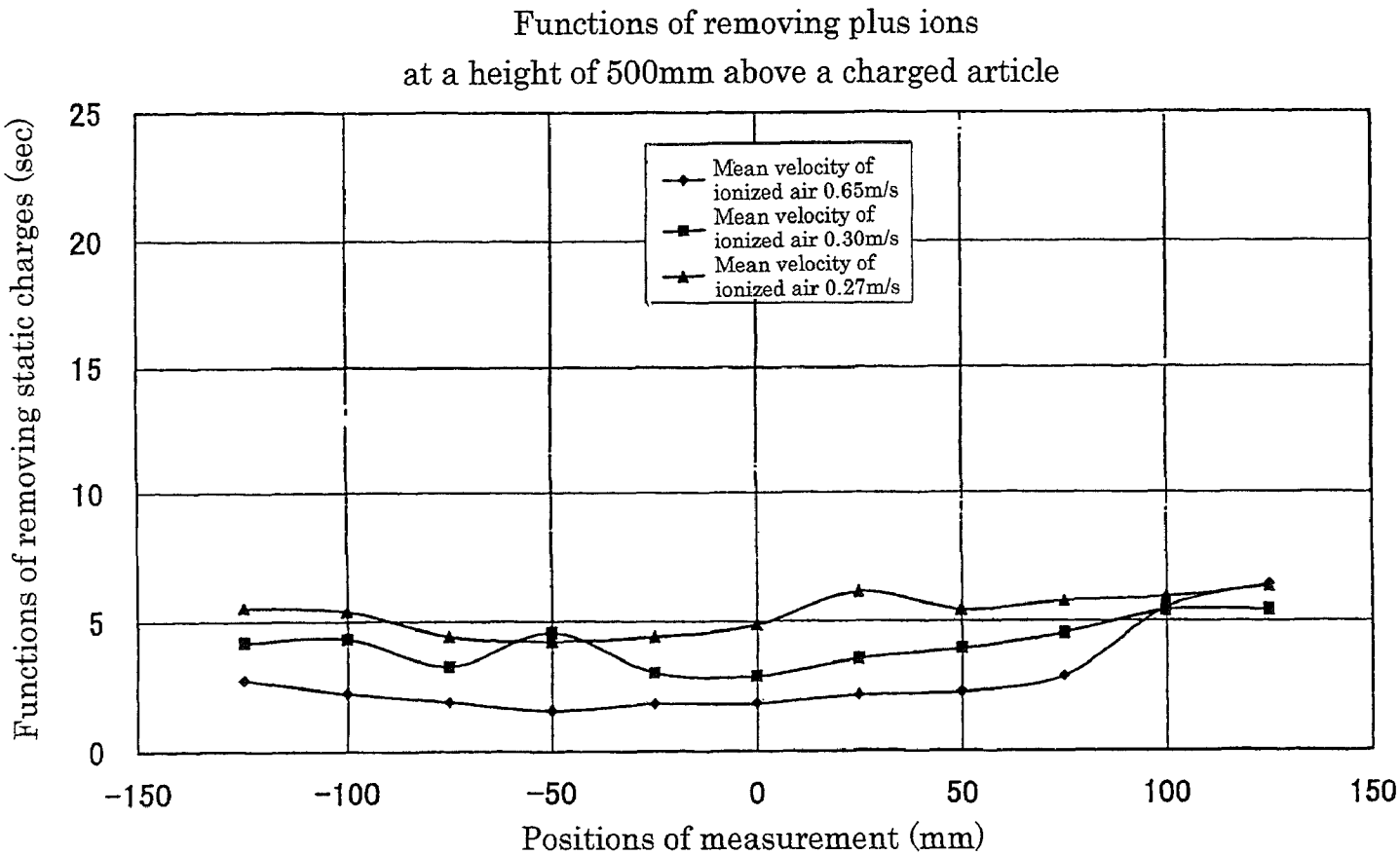
FIG. 7 is a graph showing the result of the measurement of the performance of removing the static charges by the sheet for shielding soft X-ray of the present invention being attached to the remover using soft X-rays that removes the static charges.

The invention claimed is:

1. A sheet for shielding soft X-rays that is used for a remover using soft X-rays that removes static charges, the sheet comprising:

a first outer sheet, an interlayer sheet, and a second outer sheet, that are all made of materials opaque to soft X-rays;

wherein in the first outer sheet a port for supplying ionized air is formed, in the interlayer sheet a passage for the ionized air, which passage communicates with the port for supplying the ionized air, is formed, in the second outer sheet a port for discharging the ionized air, which port communicates with the passage for the ionized air, is formed, and wherein the first outer sheet, the interlayer sheet, and the second outer sheet are stacked and adhered to form one or more portions for transmitting the ionized air that passes through the port for supplying the ionized air, the passage for the ionized air, and the port for discharging the ionized air.

2. The sheet for shielding soft X-rays that is used for a remover using soft X-rays that removes the static charges of claim 1, wherein the interlayer sheet has one or more layers, and wherein the passage for the ionized air is divided and formed in the sheet having one or more layers, and has steps.

3. The sheet for shielding soft X-rays that is used for a remover using soft X-rays that removes the static charges of claim 1, wherein the passage for the ionized air that runs from the port for supplying the ionized air to the port for discharging the ionized air has at least one bend.

4. A method of manufacturing a sheet for shielding soft X-rays that is used for a remover using soft X-rays that removes the static charges, the method comprising the steps of:

forming a port for supplying ionized air by photographic technology and etching or pressing, in a first outer sheet that is made of a material opaque to soft X-rays;

forming a passage for the ionized air by photographic technology and etching or pressing, in an interlayer sheet that is made of a material opaque to soft X-rays, the passage having a port for introducing the ionized air, which port communicates with the port for supplying the ionized air;

forming a port for discharging the ionized air by photographic technology and etching or pressing, in a second outer sheet that is made of a material opaque to soft X-rays, the port for discharging the ionized air communicating with the passage for the ionized air; and after the step of forming, stacking and adhering the sheets to form one sheet.

5. The method of manufacturing a sheet for shielding soft X-rays that is used for a remover using soft X-rays that removes the static charges of claim 4, wherein the interlayer sheet has one or more layers, and wherein the passage for the ionized air is divided and formed in the sheet having one or more layers, and has steps.

6. The method of manufacturing a sheet for shielding soft X-rays that is used for a remover using soft X-rays that removes the static charges of claim 4, wherein the passage for the ionized air that runs from the port for supplying the ionized air to the port for discharging the ionized air has at least one bend.

* * * * *